US010096913B2

(12) United States Patent
Sato

(10) Patent No.: US 10,096,913 B2
(45) Date of Patent: Oct. 9, 2018

(54) ELECTRIC WIRE WITH TERMINAL METAL FITTING

(71) Applicant: YAZAKI CORPORATION, Tokyo (JP)

(72) Inventor: Kei Sato, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/828,674

(22) Filed: Aug. 18, 2015

(65) Prior Publication Data

US 2015/0357722 A1 Dec. 10, 2015

Related U.S. Application Data

(63) Continuation of application No. PCT/JP2014/051396, filed on Jan. 23, 2014.

(30) Foreign Application Priority Data

Feb. 20, 2013 (JP) ..... 2013-030764

(51) Int. Cl.
*H01R 4/10* (2006.01)
*H01R 4/18* (2006.01)
(Continued)

(52) U.S. Cl.
CPC ..... *H01R 4/185* (2013.01); *H01R 13/5216* (2013.01); *H01R 4/188* (2013.01);
(Continued)

(58) Field of Classification Search
CPC ..... H01R 4/185; H01R 4/188; H01R 4/20; H01R 4/183; H01R 43/058; H01R 43/0484
(Continued)

(56) References Cited

U.S. PATENT DOCUMENTS 5,422,438 A * 6/1995 Lamome ..... H01R 4/203 174/76
5,518,427 A * 5/1996 Kan ..... H01R 13/521 439/276
(Continued)

FOREIGN PATENT DOCUMENTS

CN 1360369 A 7/2002
CN 101740880 A 6/2010
(Continued)

OTHER PUBLICATIONS

International Search Report for PCT/JP2014/051396 dated Apr. 28, 2014 [PCT/ISA/210].
(Continued)

*Primary Examiner* — Hien Vu
(74) *Attorney, Agent, or Firm* — Sughrue Mion, PLLC

(57) ABSTRACT

An electric wire with terminal metal fitting includes an electric wire including a conductor portion and an insulating coating portion, and a terminal metal fitting including an electric-wire coupling portion coupled to a terminal portion of the electric wire. The electric-wire coupling portion includes an exposed-conductor press-bonded portion press-bonded to the exposed conductor portion; an insulation-coating press-bonded portion press-bonded to the insulating coating portion, and an intermediate integrated continuous-contact portion ensuring integrally continuous contact between the exposed-conductor press-bonded portion and the insulation-coating press-bonded portion such that the exposed conductor portion is not exposed to the outside. The electric-wire coupling portion has an inner side surface where an insulating resin layer is formed at least in a front end portion and a rear end portion in an extending direction of the electric wire.

4 Claims, 14 Drawing Sheets

(51) Int. Cl.

| | |
|---|---|
| ***H01R 13/52*** | (2006.01) |
| *H01R 4/62* | (2006.01) |
| *H01R 13/11* | (2006.01) |

(52) U.S. Cl.
CPC ..... *H01R 4/62* (2013.01); *H01R 13/113* (2013.01); *H01R 2201/26* (2013.01)

(58) Field of Classification Search
USPC ..... 439/877, 878
See application file for complete search history.

(56) References Cited

U.S. PATENT DOCUMENTS

| | | | | |
|---|---|---|---|---|
| 5,532,433 | A * | 7/1996 | Endo | H01R 4/20 174/77 R |
| 5,630,732 | A * | 5/1997 | Yamanashi | H01R 13/5216 439/589 |
| 5,736,678 | A | 4/1998 | Kobayashi | |
| 8,616,928 | B2 * | 12/2013 | Uchiyama | H01R 4/184 439/877 |
| 8,641,461 | B2 * | 2/2014 | Mitose | H01R 4/185 439/587 |
| 2002/0077001 | A1 | 6/2002 | Chen | |
| 2010/0120302 | A1 | 5/2010 | Kumakura | |
| 2013/0040509 | A1 | 2/2013 | Mitose et al. | |
| 2013/0095708 | A1 | 4/2013 | Mitose et al. | |
| 2013/0130569 | A1 | 5/2013 | Sato | |
| 2015/0020384 | A1 | 1/2015 | Yamamoto | |

FOREIGN PATENT DOCUMENTS

| | | | |
|---|---|---|---|
| CN | 102742083 | A | 10/2012 |
| CN | 102859795 | A | 1/2013 |
| DE | 11 2013 001 897 | T5 | 1/2015 |
| JP | 03-104955 | U | 10/1991 |
| JP | 7-36364 | U | 7/1995 |
| JP | 09-115564 | A | 5/1997 |
| JP | 2010-165514 | A | 7/2010 |
| JP | 2011-243329 | A | 12/2011 |
| JP | 2012-069449 | A | 4/2012 |
| JP | 2012-155892 | A | 8/2012 |
| JP | 2013-008610 | A | 1/2013 |
| WO | 2011/096526 | A1 | 8/2011 |
| WO | 2011/122622 | A1 | 10/2011 |
| WO | 2011/142205 | A1 | 11/2011 |

OTHER PUBLICATIONS

Written Opinion for PCT/JP2014/051396 dated Apr. 28, 2014 [PCT/ISA/237].
Communication dated Sep. 29, 2016 by the Chinese Patent Office in counterpart Chinese Patent Application No. 201480009468.5.
Communication dated Oct. 4, 2016 by the Japanese Patent Office in counterpart Japanese Patent Application No. 2013-030764.
Communication dated Jun. 6, 2016 by the Japanese Patent Office in counterpart Japanese Patent Application No. 2013-030764.
Communication dated Aug. 15, 2016 by the Japanese Patent Office in counterpart Japanese Patent Application No. 2013-030764.
Communication from the German Patent Office dated Nov. 2, 2016 in counterpart German Patent Application No. 11 2014 000 921.0.
Communication dated Mar. 28, 2017, issued by the Japanese Patent Office in counterpart Japanese application No. 2013-30764.

* cited by examiner

ELECTRIC WIRE WITH TERMINAL METAL FITTING

CROSS-REFERENCE TO RELATED APPLICATION

This application is a continuation application of International Application PCT/JP2014/051396, filed on Jan. 23, 2014, which claims priority from Japanese Patent Application No. 2013-030764 filed on Feb. 20, 2013 and designating the U.S., the entire contents of which are incorporated herein by reference.

BACKGROUND OF THE INVENTION

1. Field of the Invention

The present invention relates to an electric wire with terminal metal fitting that includes an electric wire that includes a conductor portion and an insulating coating portion surrounding the outer periphery of the conductor portion, and a terminal metal fitting that includes an electric-wire coupled portion coupled to a terminal portion of the electric wire.

2. Description of the Related Art

Conventionally, an electric wire with terminal metal fitting is used for a wire harness or the like routed in a vehicle. The electric wire with terminal metal fitting includes an electric wire that includes a conductor portion and an insulating coating portion surrounding the outer periphery of the conductor portion, and a terminal metal fitting that includes an electric-wire coupling portion coupled to the terminal portion of the electric wire.

Incidentally, in recent years, in the automobile industry, it has been an important problem to reduce the weight of the vehicle so as to improve the fuel efficiency taking into consideration the environment. This has attracted attention to an electric wire with terminal metal fitting that includes: an electric wire that includes a conductor portion employing a conductor portion made of aluminum or aluminum alloy, which is lighter than copper, and an insulating coating portion surrounding the outer periphery of this conductor portion; and a terminal metal fitting that includes an electric-wire coupling portion coupled to a terminal portion of this electric wire.

However, there has been a problem that aluminum is likely to corrode under the presence of water and copper ions, and thus water invasion into the coupling portion between the conductor portion made of aluminum or aluminum alloy and the terminal metal fitting made of copper is likely to cause corrosion.

Therefore, to prevent water adhesion to the conductor portion so as to prevent erosion of the conductor portion, for example, Japanese Patent Application Laid-open No. 2010-165514 discloses a terminal metal fitting attachment where an anticorrosive to prevent erosion of the conductor portion is applied over the surface where the exposed conductor portion is disposed.

However, the electric wire with terminal metal fitting employing the terminal metal fitting attachment described in Japanese Patent Application Laid-open No. 2010-165514 includes a large exposed portion of the core wire between a core wire barrel piece and an insulation-coating barrel piece. Accordingly, the anticorrosive applied over the inside of the barrel piece might not completely extend to the exposed portion and not achieve anticorrosion as a result.

SUMMARY OF THE INVENTION

The present invention has been made in view of the above-described circumstances, and it is an object of the present invention to provide an electric wire with terminal metal fitting that allows improving the anticorrosive performance.

In order to solve the above mentioned problem and achieve the object, an electric wire with terminal metal fitting according to one aspect of the present invention includes an electric wire including a conductor portion, and an insulating coating portion surrounding an outer periphery of the conductor portion; and a terminal metal fitting including an electric-wire coupling portion coupled to a terminal portion of the electric wire, wherein the electric-wire coupling portion includes: an exposed-conductor press-bonded portion disposed on a front end side in an extending direction of the electric wire and press-bonded to the conductor portion exposed by removing the insulating coating portion in a distal end of the terminal portion; an insulation-coating press-bonded portion disposed on a rear end side in the extending direction of the electric wire and press-bonded to the insulating coating portion; and an intermediate integrated continuous-contact portion configured to ensure integrally continuous contact between the exposed-conductor press-bonded portion and the insulation-coating press-bonded portion along the extending direction of the electric wire such that the exposed conductor portion is not exposed to an outside, and the electric-wire coupling portion has an inner side surface where an insulating resin layer is formed at least in a front end portion and a rear end portion in the extending direction of the electric wire, and, on the inner side surface of the electric-wire coupling portion, an unformed portion of the insulating resin layer is formed in at least a part of a portion press-bonded to the conductor portion, and the insulating resin is thermoplastic resin, and the insulating resin is heated at a temperature where the insulating resin is melted such that a gap between the terminal metal fitting and the electric wire is sealed by the insulating resin in the front end portion and the rear end portion in the electric-wire coupled portion.

Further, in the electric wire with terminal metal fitting according to another aspect of the present invention, a distal end portion of the exposed conductor portion is housed within the exposed-conductor press-bonded portion.

Further, in the electric wire with terminal metal fitting according to still another aspect of the present invention, the electric-wire coupling portion has a tube shape where both side end portions of a plate-shaped portion are mated with each other, and the insulation-coating press-bonded portion includes a pair of press-bonded piece portions formed by slitting the both side end portions in flaky shapes.

Further, in the electric wire with terminal metal fitting according to still another aspect of the present invention, the insulation-coating press-bonded portion includes a through-hole formed in at least one position.

Further, in the electric wire with terminal metal fitting according to still another aspect of the present invention, the exposed-conductor press-bonded portion and the insulation-coating press-bonded portion include an uneven surface portion formed as an irregular shape on the inner side surface.

Further, in the electric wire with terminal metal fitting according to still another aspect of the present invention, the electric-wire coupling portion is formed in a tube shape where both side end portions of a plate-shaped portion are mated with each other.

Further, in the electric wire with terminal metal fitting according to still another aspect of the present invention, the exposed-conductor press-bonded portion includes the insulating resin layer formed on an inner side surface of the side end portion on an outer side in the both side end portions overlapping with each other.

Further, in the electric wire with terminal metal fitting according to still another aspect of the present invention, the conductor portion is made of aluminum or aluminum alloy, and the terminal metal fitting is made of copper or copper alloy.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes preferred embodiments of an electric wire with terminal metal fitting according to the present invention in detail with reference to the drawings.

Figure 1:
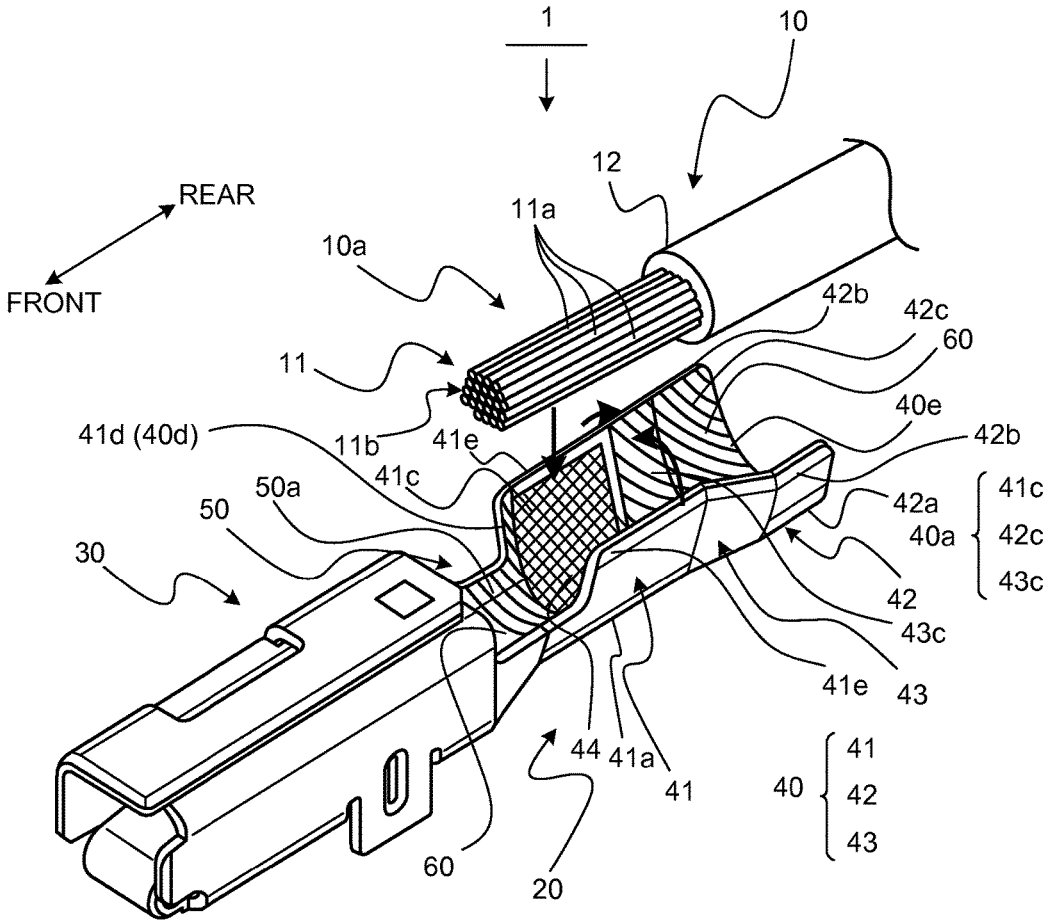
FIG. 1 is an exploded perspective view of an electric wire with terminal metal fitting according to an embodiment of the present invention.
Figure 2:
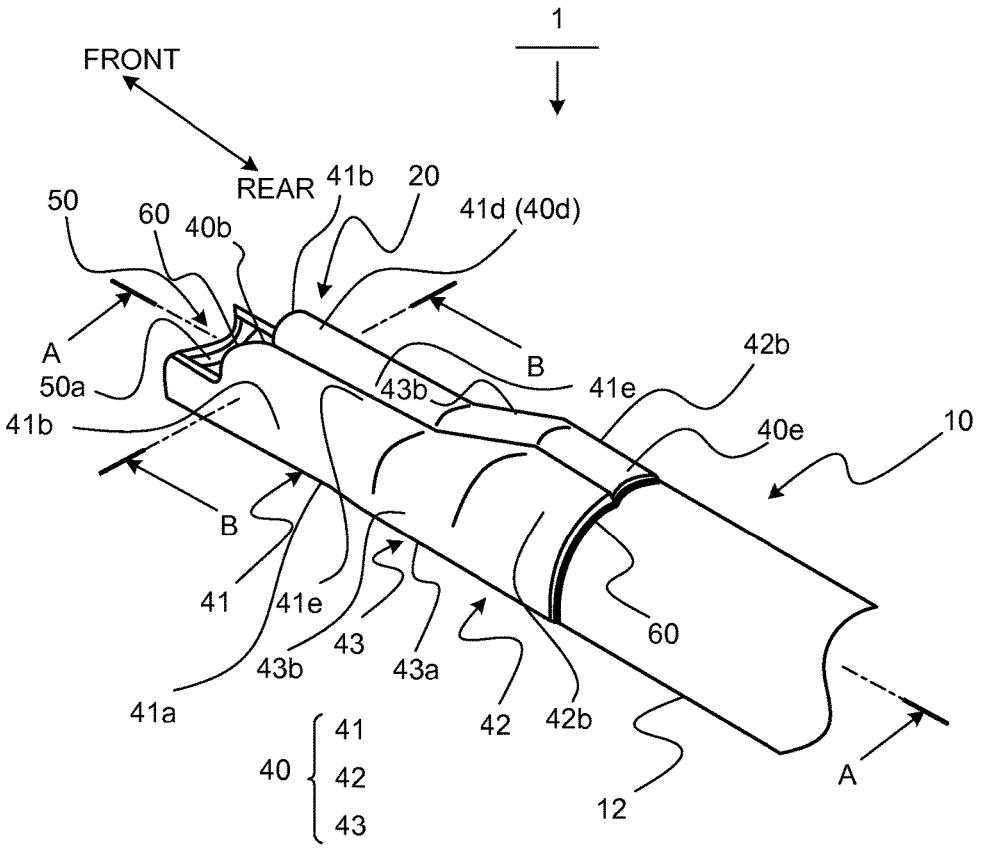
FIG. 2 is an enlarged perspective view of the vicinity of an electric-wire coupling portion of the electric wire with terminal metal fitting illustrated in FIG. 1.
Figure 3:
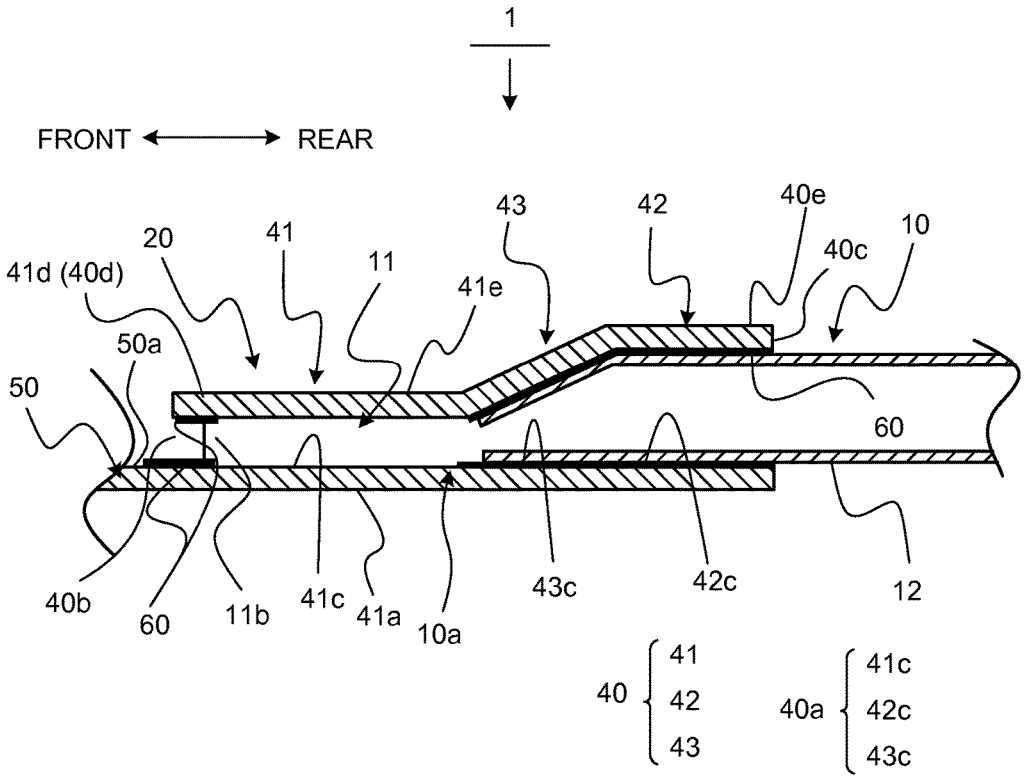
FIG. 3 is an A-A line cross-sectional view of the electric wire with terminal metal fitting illustrated in FIG. 2.
Figure 4:
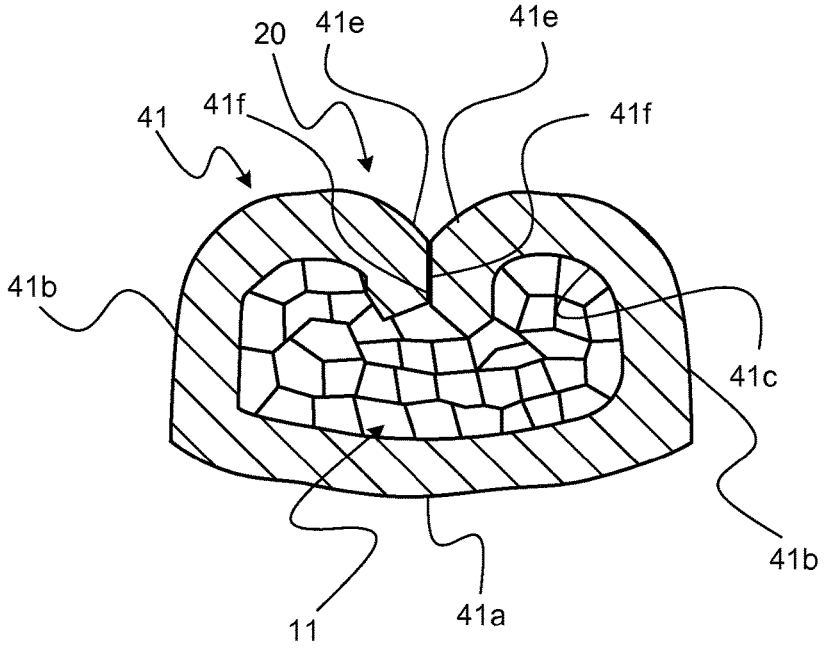
FIG. 4 is a B-B line cross-sectional view of the electric wire with terminal metal fitting illustrated in FIG. 2.

FIG. 1 is an exploded perspective view of an electric wire with terminal metal fitting 1 according to an embodiment of the present invention. FIG. 2 is an enlarged perspective view of the vicinity of an electric-wire coupling portion 40 of the electric wire with terminal metal fitting 1 illustrated in FIG. 1. FIG. 3 is an A-A line cross-sectional view of the electric wire with terminal metal fitting 1 illustrated in FIG. 2. FIG. 4 is a B-B line cross-sectional view of the electric wire with terminal metal fitting 1 illustrated in FIG. 2.

Here, in the embodiment of the present invention, for convenience of explanation, the front-rear direction is defined as illustrated by the arrows in the drawings.

An electric wire with terminal metal fitting 1 according to the embodiment of the present invention includes: an electric wire 10, which includes a conductor portion 11 and an insulating coating portion 12 surrounding the outer periphery of the conductor portion 11; and a terminal metal fitting 20, which includes the electric-wire coupling portion 40 coupled to a terminal portion 10*a* of the electric wire 10.

Firstly, the electric wire 10 will be described.

The conductor portion 11 is formed by making a bundle of a plurality of element wires 11*a* made of aluminum or aluminum alloy.

The insulating coating portion 12 is made of insulating synthetic resin, and is formed surrounding the outer periphery of the conductor portion 11 so as to protect the conductor portion 11 to be insulated from the outside.

Here, the conductor portion 11 including a bundle of the plurality of element wires 11*a* is exemplified. However, the conductor portion 11 is not limited to this, and may employ a single core wire.

The following describes the terminal metal fitting 20.

The terminal metal fitting 20 is a terminal metal fitting obtained by metal mold press working or the like to mold a plate-shaped member made of metal such as copper or copper alloy. This terminal metal fitting 20 includes: a partner-terminal coupling portion 30 as the coupling portion to a coupling partner terminal (not illustrated); the electric-wire coupling portion 40 coupled to the terminal portion 10*a* of the electric wire 10; and an intermediate portion 50 coupling the partner-terminal coupling portion 30 to the electric-wire coupling portion 40.

In the partner-terminal coupling portion 30, an elastic contact piece disposed within the tube of a coupling main body portion in a rectangular tube shape is brought into contact with a partner terminal (not illustrated).

The electric-wire coupling portion 40 has a tube shape where the both side end portions of a plate-shaped portion mate with each other, and includes: an exposed-conductor press-bonded portion 41, which is press-bonded to the exposed conductor portion 11; an insulation-coating press-bonded portion 42, which is press-bonded to the insulating coating portion 12; and an intermediate integrated continuous-contact portion 43, which ensures continuous contact between the exposed-conductor press-bonded portion 41 and the insulation-coating press-bonded portion 42.

The exposed-conductor press-bonded portion 41 is a portion that is: disposed on the front end side of the electric-wire coupling portion 40 in the extending direction of the electric wire 10; and is press-bonded to the conductor portion 11 exposed by removing the insulating coating portion 12 in the distal end of the terminal portion 10*a* of the electric wire 10. Here, the front end side of the electric-wire coupling portion 40 in the extending direction of the electric wire 10 typically corresponds to the distal end side of the terminal portion 10*a* of the electric wire 10, in other words, a distal end portion 11*b* side of the conductor portion 11 exposed from the insulating coating portion 12.

This exposed-conductor press-bonded portion 41 includes: a conductor press-bonded bottom-wall portion 41*a* where the exposed conductor portion 11 is placed; and a pair of conductor press-bonded standing wall portions 41*b*, which stands from the both side edges of the conductor press-bonded bottom-wall portion 41*a* and is press-bonded to surround the outer periphery of the conductor portion 11 from the both side portions to the top of the conductor portion 11.

In the exposed-conductor press-bonded portion 41, an inner side surface 41*c* includes an uneven surface portion 44 formed in an irregular shape. More specifically, the uneven surface portion 44 is a portion that includes diamond-shaped protruding portions continuously formed in a plurality of portions on the inner side surface 41*c*. This uneven surface portion 44 has a function that increases the contacted area between the exposed-conductor press-bonded portion 41 and the conductor portion 11 so as to enhance the close contact strength.

Here, while in the electric wire with terminal metal fitting 1 according to this embodiment the uneven surface portion 44 including the diamond-shaped protruding portions continuously formed in the plurality of portions on the inner side surface 41*c* is exemplified, the configuration is not limited to this. Another shape may be used insofar as the inner side surface 41*c* of the exposed-conductor press-bonded portion 41 is formed in an irregular shape.

The insulation-coating press-bonded portion 42 is a portion that is: disposed on the rear end side of the electric-wire coupling portion 40 in the extending direction of the electric wire 10; and press-bonded to the insulating coating portion 12. Here, the rear end side of the electric-wire coupling portion 40 in the extending direction of the electric wire 10 typically corresponds to the base end side on the opposite side to the distal end side of the terminal portion 10*a* of the electric wire 10, in other words, the insulating coating portion 12 side.

This insulation-coating press-bonded portion 42 includes: an insulation-coating press-bonded bottom-wall portion 42*a* on which the insulating coating portion 12 is placed; and a pair of insulation-coating press-bonded standing wall portions 42*b*, which stands from the both side edges of the insulation-coating press-bonded bottom-wall portion 42*a* and is press-bonded to surround the outer periphery of the insulating coating portion 12 from the both side portions to the top of the insulating coating portion 12.

The intermediate integrated continuous-contact portion 43 is a portion that ensures integrally continuous contact between the exposed-conductor press-bonded portion 41 and the insulation-coating press-bonded portion 42 along the extending direction of the electric wire 10 such that the exposed conductor portion 11 is not exposed to the outside. That is, this intermediate integrated continuous-contact portion 43 is a portion that ensures integrally continuous contact between the exposed-conductor press-bonded portion 41 and the insulation-coating press-bonded portion 42 along the extending direction of the electric wire 10 such that the conductor portion 11 exposed from the insulating coating portion 12 is not exposed to the outside.

This intermediate integrated continuous-contact portion 43 includes: an intermediate bottom-wall portion 43*a* on which the insulating coating portion 12 is placed; and a pair of intermediate standing wall portions 43*b*, which stands from the both side edges of the intermediate bottom-wall portion 43*a* and is press-bonded to surround the outer periphery of the insulating coating portion 12 from the both side portions to the top of the insulating coating portion 12.

This intermediate integrated continuous-contact portion 43 ensures continuous contact between the exposed-conductor press-bonded portion 41 and the insulation-coating press-bonded portion 42 such that the exposed-conductor press-bonded portion 41 and the insulation-coating press-bonded portion 42 are each likely to be press-bonded to the electric wire 10.

More specifically, the intermediate integrated continuous-contact portion 43 is press-bonded to the electric wire 10 such that the outer diameter of the electric wire 10 gradually decreases from the insulation-coating press-bonded portion 42 toward the exposed-conductor press-bonded portion 41, so as to decrease the difference between the outer diameter of the electric wire 10 in the portion covered with the insulating coating portion 12 and the outer diameter of the electric wire 10 in the portion of the exposed conductor portion 11.

In this terminal metal fitting 20, an insulating resin layer 60 is formed in: the whole region on an inner side surface 50*a* of the intermediate portion 50; a front end portion 41*d* on the inner side surface 41*c* of the exposed-conductor press-bonded portion 41; the whole region on an inner side surface 43*c* of the intermediate integrated continuous-contact portion 43; and the whole region on an inner side surface 42*c* of the insulation-coating press-bonded portion 42. That is, in the terminal metal fitting 20, an unformed portion of the insulating resin layer 60 is formed in the portion except the front end portion 41*d* on the inner side surface 40*a* of the electric-wire coupling portion 40.

Accordingly, the terminal metal fitting 20 is coupled to the electric wire 10 and then the terminal metal fitting 20 is heated at a temperature where insulating resin R is melted such that, as illustrated in FIG. 3, the exposed-conductor press-bonded portion 41 is electrically coupled to the conductor portion 11 in the unformed portion of the insulating resin layer 60 in the exposed-conductor press-bonded portion 41, and a front end opening 40*b* and a rear end opening 40*c* of the electric-wire coupling portion 40 are sealed by the insulating resin R. This allows preventing water invasion into the exposed conductor portion 11 from the outside of the terminal metal fitting 20.

In this embodiment, the distal end portion 11*b* of the exposed conductor portion 11 of the electric wire 10 is housed within the exposed-conductor press-bonded portion 41. Accordingly, the distal end portion 11*b* of the exposed conductor portion 11 is reliably covered with the insulating resin R by melting the insulating resin layer 60 formed in the front end portion 41*d* of the inner side surface 41*c* in the exposed-conductor press-bonded portion 41.

Here, the insulating resin R employs thermoplastic resin, and, specifically, the insulating resin R such as polyethylene and polypropylene is exemplified. The insulating resin R is not limited to this, and may employ another insulating resin.

Figure 5:
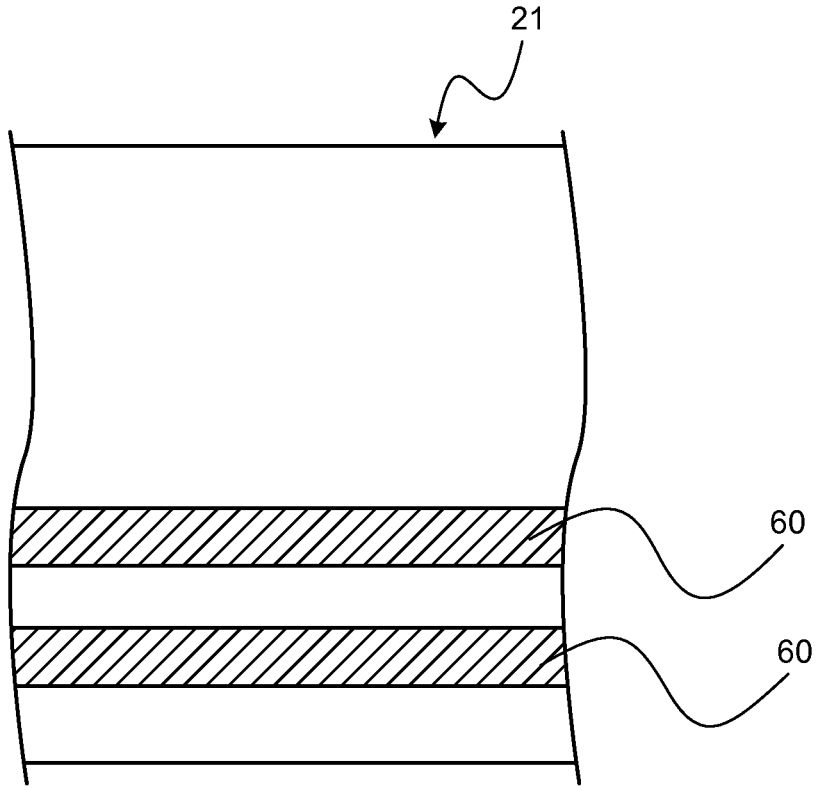
FIG. 5 is a diagram illustrating a manufacturing procedure for the electric wire with terminal metal fitting.
Figure 6:
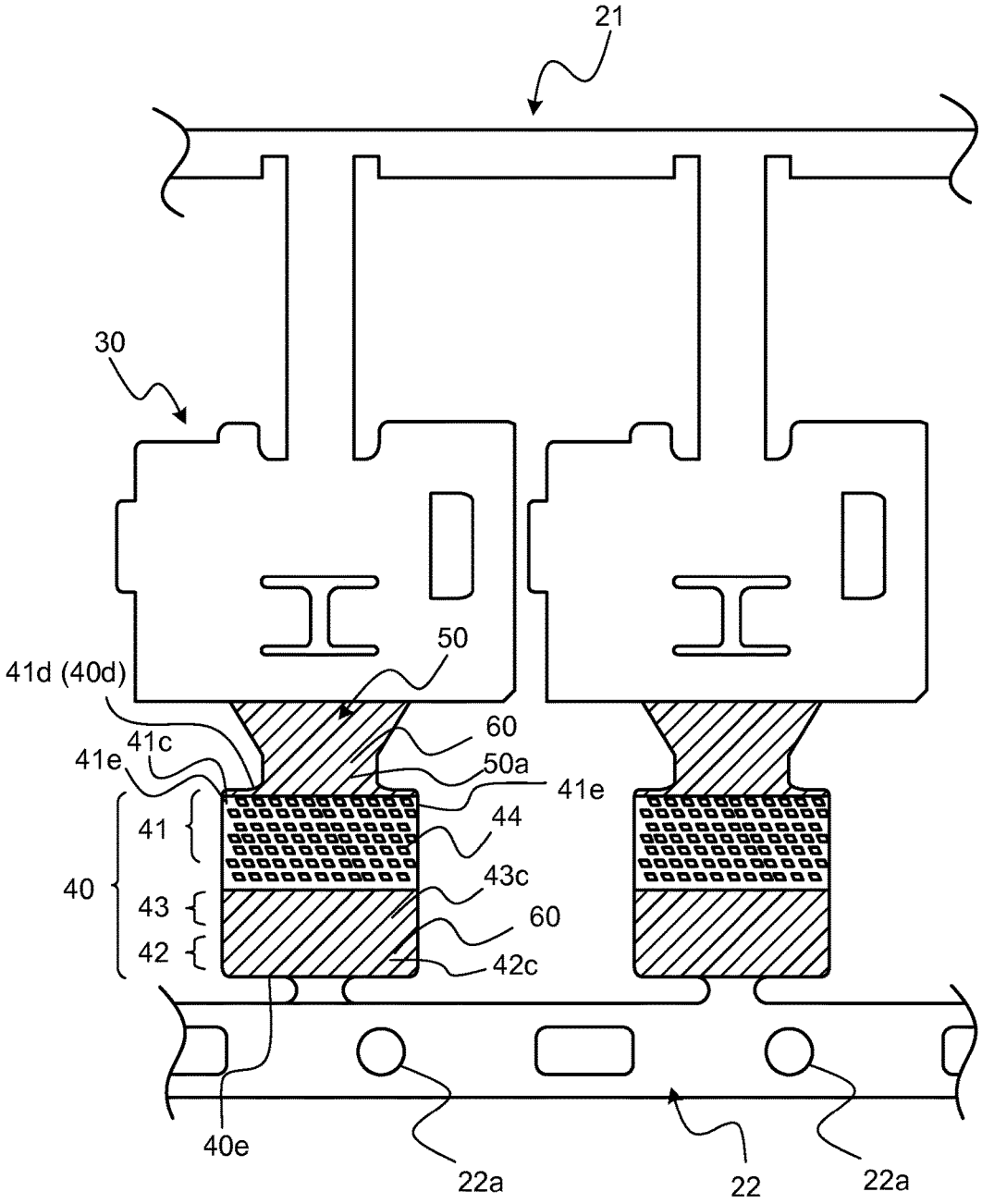
FIG. 6 is a diagram illustrating the manufacturing procedure for the electric wire with terminal metal fitting.
Figure 7:
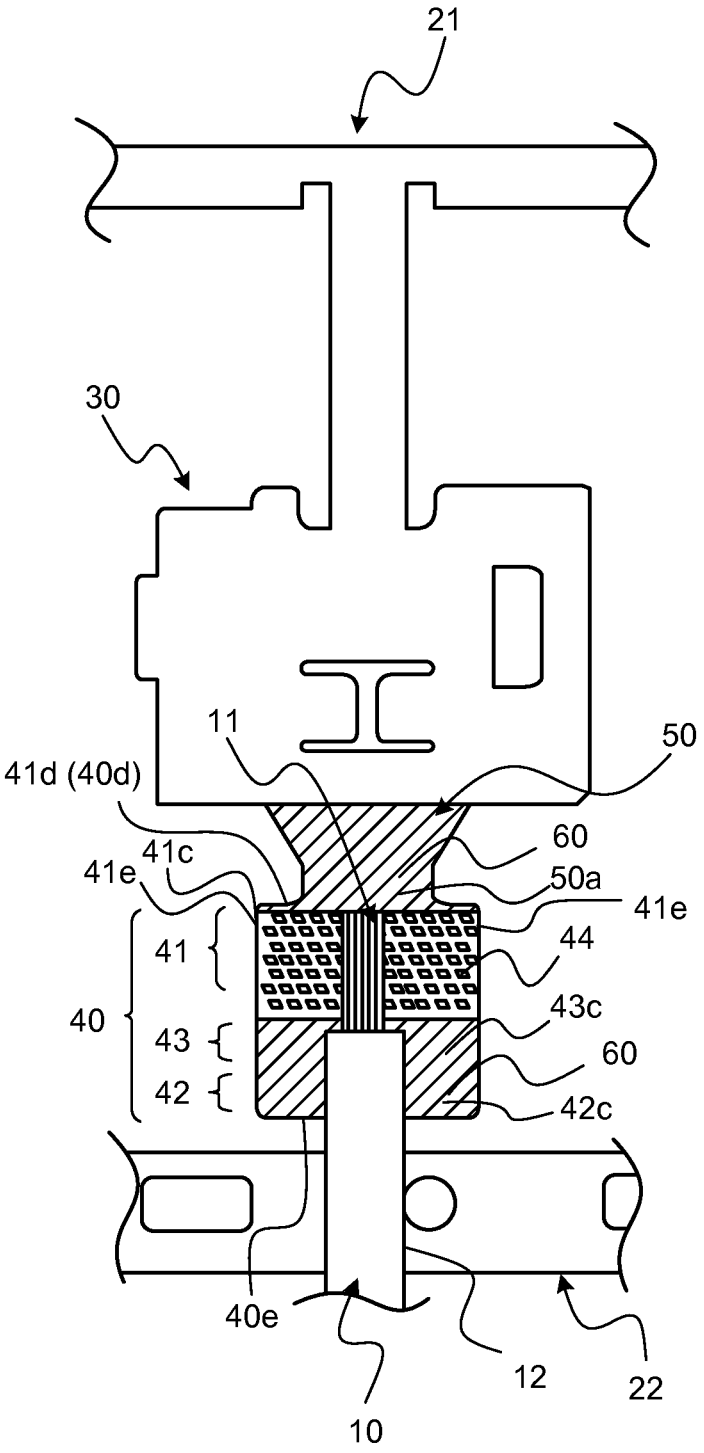
FIG. 7 is a diagram illustrating the manufacturing procedure for the electric wire with terminal metal fitting.

Here, using FIGS. 5 to 7, the manufacturing procedure of the electric wire with terminal metal fitting will be described. FIGS. 5 to 7 are diagrams illustrating the manufacturing procedure of the electric wire with terminal metal fitting 1.

Firstly, the worker uses a processing machine (not illustrated) to leave the unformed portion on the inner side surface 41*c* of the exposed-conductor press-bonded portion 41 on the inner side surface of the terminal metal fitting 20, so as to form the insulating resin layer 60 (see FIG. 5).

In this resin-layer forming process, the insulating resin layer 60 is formed in a plate-shaped member 21 before a plurality of the terminal metal fittings 20 are processed by punching. Here, in the case where the insulating resin layer 60 is partially formed in the plate-shaped member 21, for example, masking is performed in the portion corresponding to the unformed portion of the insulating resin layer 60 and then the insulating resin R is applied.

Here, in this embodiment, the insulating resin layer 60 is formed in: the whole region on the inner side surface 50*a* of the intermediate portion 50; the front end portion 41*d* on the inner side surface 41*c* of the exposed-conductor press-bonded portion 41; the whole region on the inner side surface 43*c* of the intermediate integrated continuous-contact portion 43; and the whole region on the inner side surface 42*c* of the insulation-coating press-bonded portion 42. The unformed portion of the insulating resin layer 60 is formed in the portion except the front end portion 41*d* on the inner side surface 41*c* of the exposed-conductor press-bonded portion 41.

This allows forming: the portions where the insulating resin layer 60 is formed; and the unformed portions of the insulating resin layer 60, on a continuous straight line in the lateral direction in the drawing in the plate-shaped member 21.

Thus, the insulating resin layer 60 is formed in the plate-shaped member 21 before the plurality of the terminal metal fittings 20 are punched, so as to form the insulating resin layer 60 collectively in the plurality of the terminal metal fittings 20.

Here, the insulating resin layer 60 may be formed after the plate-shaped member 21 is processed by punching.

Subsequently, the worker uses a processing machine (not illustrated) to perform a punching process on the plate-shaped member 21 for the terminal metal fitting 20 (see FIG. 6). This punching process causes formation of the plurality of the terminal metal fittings 20 in developed states. Additionally, this punching process causes formation of a strip-shaped carrier 22 coupling the plurality of the terminal metal fittings 20. Insertion of the stops for conveyance of a processing machine (not illustrated) into feed holes 22*a* formed in this carrier 22 causes conveyance of the punched plate-shaped member 21 to the subsequent process.

Subsequently, the worker uses a processing machine (not illustrated) to perform a bending process on the terminal metal fitting 20 in the developed state so as to mold the terminal metal fitting 20 into a predetermined shape, and couples the electric-wire coupling portion 40 of the terminal metal fitting 20 to the electric wire 10 (see FIG. 7). Accordingly, the unformed portion of the insulating resin layer 60 in the exposed-conductor press-bonded portion 41 is press-bonded to the conductor portion 11 so as to electrically couple the terminal metal fitting 20 to the electric wire 10.

Subsequently, the worker uses a processing machine (not illustrated) to heat the terminal metal fitting 20 at a temperature where the insulating resin R is melted. Accordingly, as illustrated in FIG. 3, the gaps between the terminal metal fitting 20 and the electric wire 10 in the front end opening 40*b* and the rear end opening 40*c* of the electric-wire coupling portion 40 are sealed by the insulating resin R. Here, both side end portions 41*e* and 41*e* of the exposed-conductor press-bonded portion 41 are gaplessly mated with each other. This allows preventing water invasion from this mating surface 41*f*.

With the electric wire with terminal metal fitting 1 according to the embodiment of the present invention, the intermediate integrated continuous-contact portion 43 ensures integrally continuous contact between the exposed-conductor press-bonded portion 41 and the insulation-coating press-bonded portion 42 along the extending direction of the electric wire 10 such that the exposed conductor portion 11 is not exposed to the outside. Additionally, the insulating resin layer 60 is formed at least in the front end portion 40*d* and the rear end portion 40*e* in the extending direction of the electric wire 10 on the inner side surface 40*a* of the electric-wire coupling portion 40. Accordingly, in the case where the insulating resin R is heated at the melting temperature, the gap between the terminal metal fitting 20 and the electric wire 10 can be sealed by the insulating resin R in the front end portion 40*d* and the rear end portion 40*e* of the electric-wire coupling portion 40. This allows preventing water invasion into the exposed conductor portion 11 from the outside of the terminal metal fitting 20, thus consequently improving the anticorrosive performance.

With the electric wire with terminal metal fitting 1 according to the embodiment of the present invention allows reliably covering the distal end of the conductor portion 11 exposed by melting the insulating resin layer 60 formed in the front end portion 40*d* in the extending direction of the electric wire 10 on the inner side surface 40*a* of the electric-wire coupling portion 40.

(First Modification)

Figure 8:
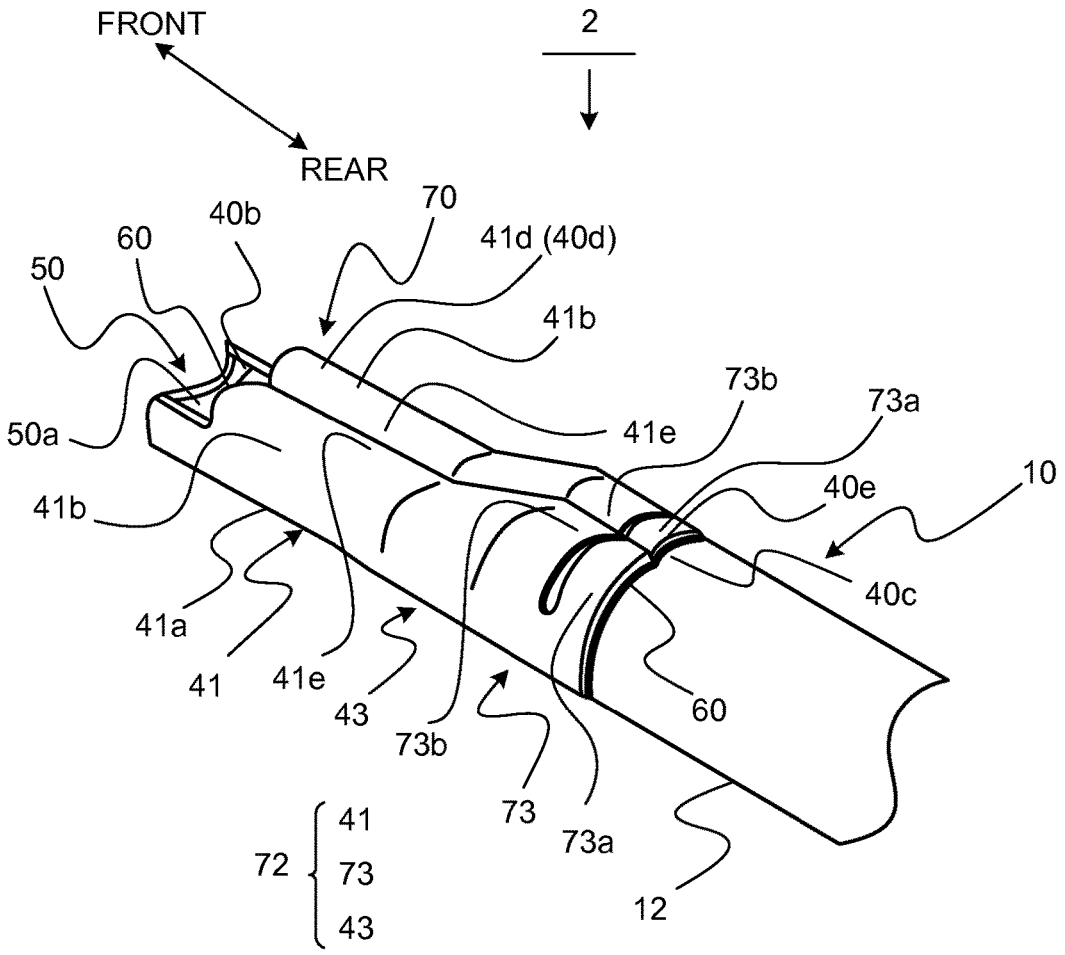
FIG. 8 is an enlarged perspective view of the vicinity of an electric-wire coupling portion of an electric wire with terminal metal fitting according to a first modification of the embodiment of the present invention.
Figure 9:
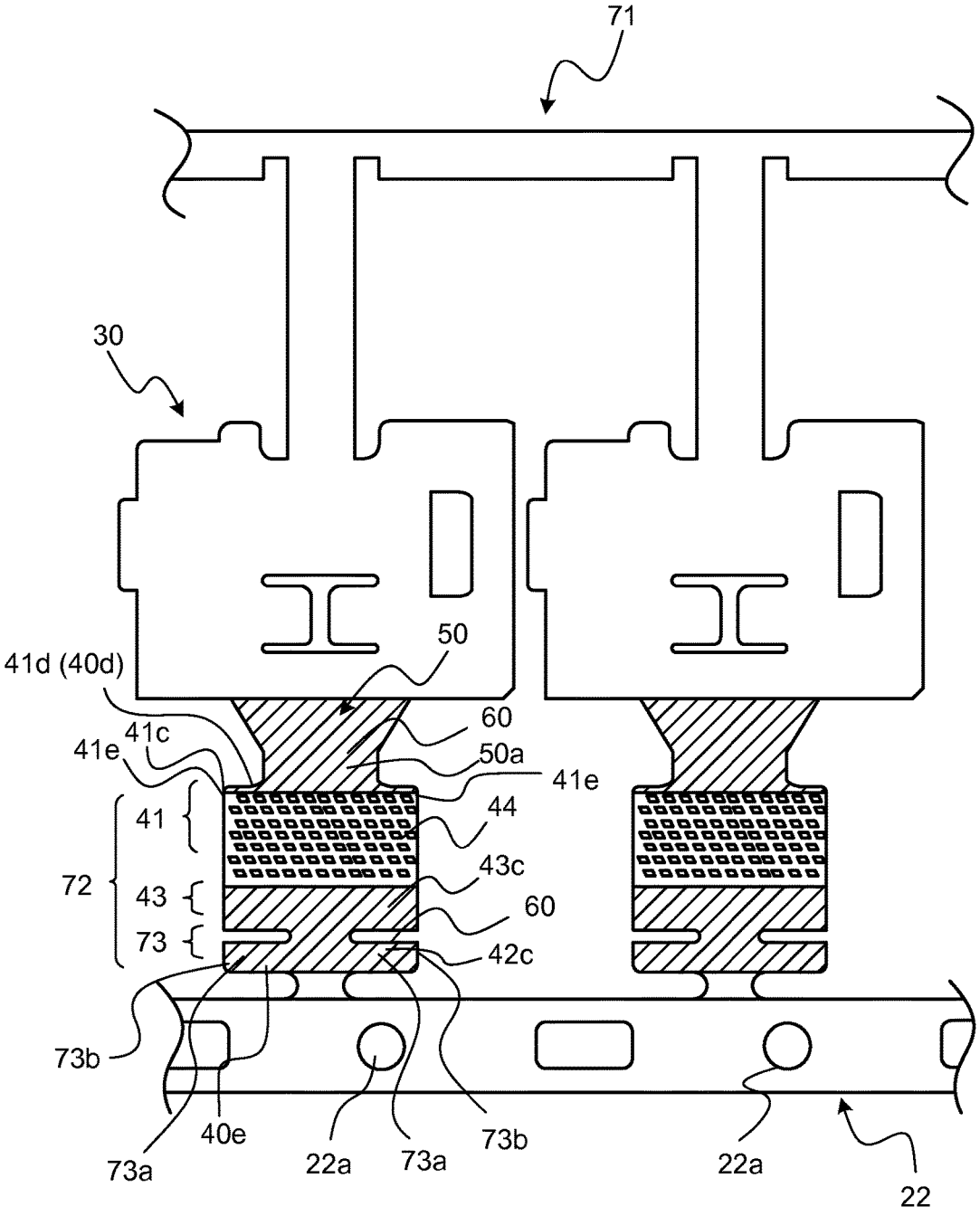
FIG. 9 is a diagram illustrating a punched state of a plate-shaped member to be the material of the terminal metal fitting illustrated in FIG. 8.

The following describes a first modification of the electric wire with terminal metal fitting 1 according to the embodiment of the present invention using FIGS. 8 and 9. FIG. 8 is an enlarged perspective view of the vicinity of an electric-wire coupling portion 72 of an electric wire with terminal metal fitting 2 according to the first modification of the embodiment of the present invention. FIG. 9 is a diagram illustrating a punched state of a plate-shaped member 71 to be the material of a terminal metal fitting 70 illustrated in FIG. 8.

The electric wire with terminal metal fitting 2 of this first modification is different from the electric wire with terminal metal fitting 1 of the embodiment in that a pair of press-bonded piece portions 73*a* and 73*a* is formed in an insulation-coating press-bonded portion 73 of the terminal metal fitting 70.

Here, the other configurations are similar to those in the embodiment, and like reference numerals designate the configuration portions in common with the embodiment.

The terminal metal fitting 70 includes the pair of press-bonded piece portions 73*a* and 73*a* formed by slitting both side end portions 73*b* and 73*b* of the insulation-coating press-bonded portion 73 in flaky shapes. This pair of press-bonded piece portions 73*a* and 73*a* is likely to be bent and deformed.

The electric wire with terminal metal fitting 2 of this first modification allows preventing water invasion into the exposed conductor portion 11 from the outside of the terminal metal fitting 70, similarly to the electric wire with terminal metal fitting 1 of the embodiment. This consequently allows improving the anticorrosive performance. Additionally, the pair of press-bonded piece portions 73*a* and 73*a*, which is formed in the insulation-coating press-bonded portion 73, is likely to be bent and deformed. This facilitates press-bonding the insulation-coating press-bonded portion 73 to the insulating coating portion 12. Moreover, the insulating coating portion 12 digs into the slit-shaped notch. This allows enhancing the close contact strength between the insulation-coating press-bonded portion 73 and the insulating coating portion 12.

(Second Modification)

Figure 10:
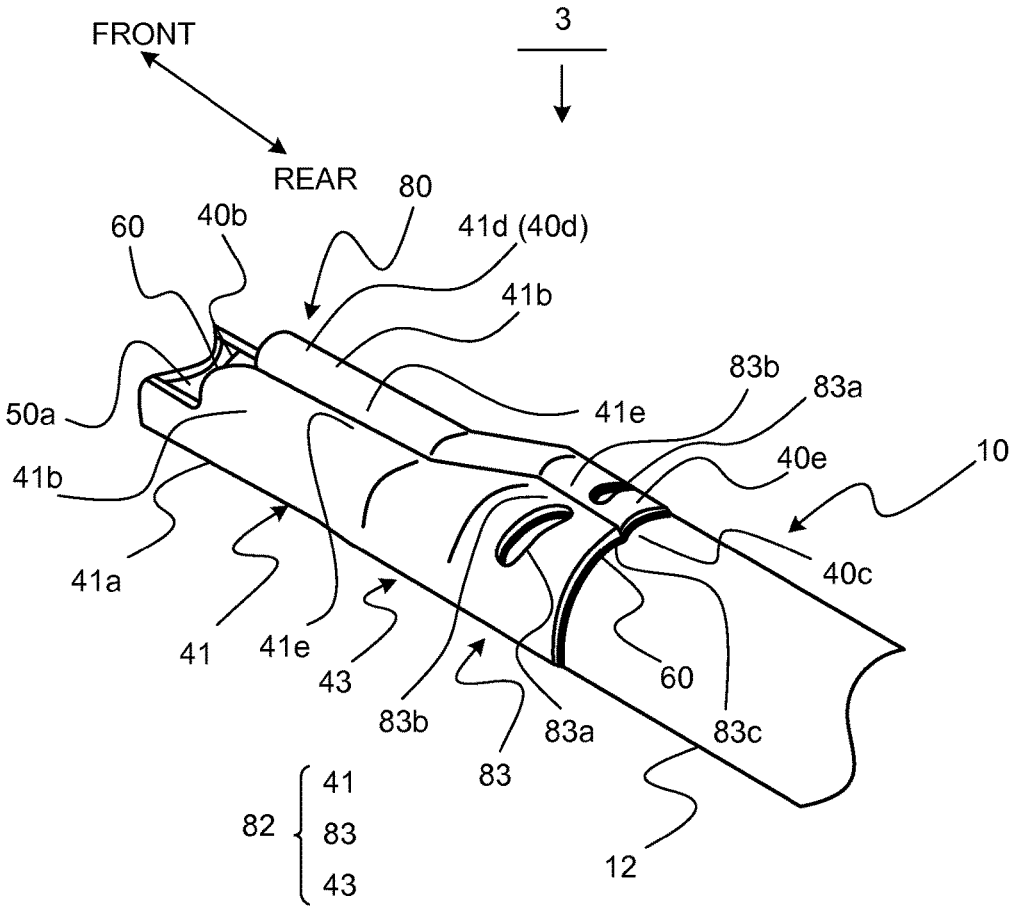
FIG. 10 is an enlarged perspective view of the vicinity of an electric-wire coupling portion of an electric wire with terminal metal fitting according to a second modification of the embodiment of the present invention.
Figure 11:
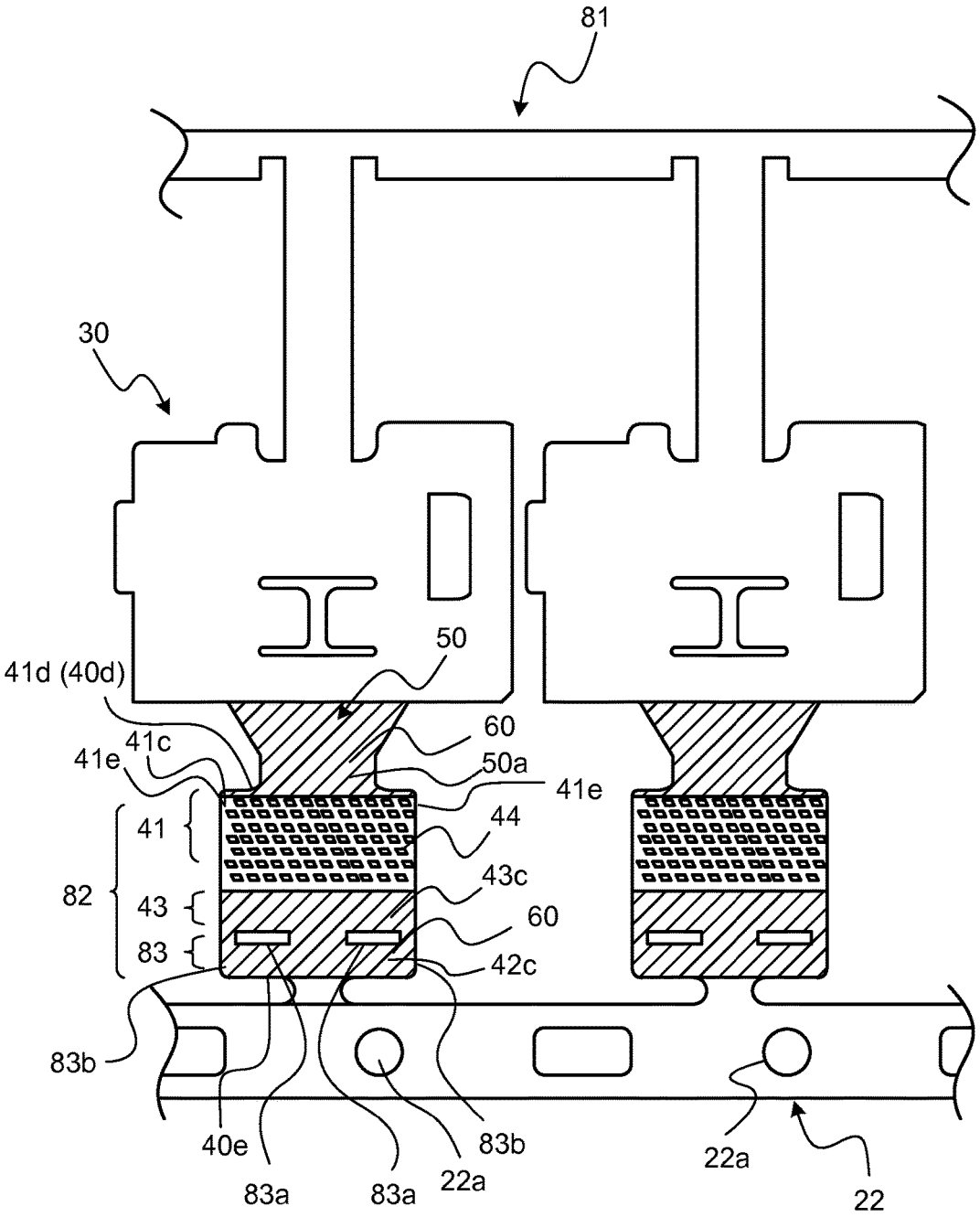
FIG. 11 is a diagram illustrating a punched state of a plate-shaped member to be the material of the terminal metal fitting illustrated in FIG. 10.

The following describes a second modification of the electric wire with terminal metal fitting 1 according to the embodiment of the present invention using FIGS. 10 and 11.

FIG. 10 is an enlarged perspective view of the vicinity of an electric-wire coupling portion 82 of an electric wire with terminal metal fitting 3 according to the second modification of the embodiment of the present invention. FIG. 11 is a diagram illustrating a punched state of a plate-shaped member 81 to be the material of the terminal metal fitting illustrated in FIG. 10.

The electric wire with terminal metal fitting 3 of this second modification is different from the electric wire with terminal metal fitting 1 of the embodiment in that through-holes are formed in an insulation-coating press-bonded portion 83 of a terminal metal fitting 80.

Here, the other configurations are similar to those in the embodiment, and like reference numerals designate the configuration portions in common with the embodiment.

The terminal metal fitting 80 includes through-holes 83*a* formed in two positions in the insulation-coating press-bonded portion 83. More specifically, the respective through-holes 83*a* sandwich a mating surface 83*c* of both side end portions 83*b* and 83*b* of the insulation-coating press-bonded portion 83 and are disposed in the vicinity of the mating surface 83*c*.

In the case where the insulation-coating press-bonded portion 83 is press-bonded to the insulating coating portion 12, the insulating coating portion 12 digs into the inside of the through-holes 83*a*. Accordingly, this terminal metal fitting 80 is more reliably press-bonded to the insulating coating portion 12 of the electric wire 10.

Here, while in the electric wire with terminal metal fitting 3 of this second modification the through-holes 83*a* formed in the two positions in the insulation-coating press-bonded portion 83 are exemplified, the configuration is not limited to this. The through-hole 83*a* only needs to be formed at least one position in the insulation-coating press-bonded portion 83.

The electric wire with terminal metal fitting 3 of this second modification allows preventing water invasion into the exposed conductor portion 11 from the outside of the terminal metal fitting 80, similarly to the electric wire with terminal metal fitting 1 of the embodiment. This consequently allows improving the anticorrosive performance. Additionally, the terminal metal fitting 80 is more reliably press-bonded to the insulating coating portion 12.

(Third Modification)

Figure 12A:
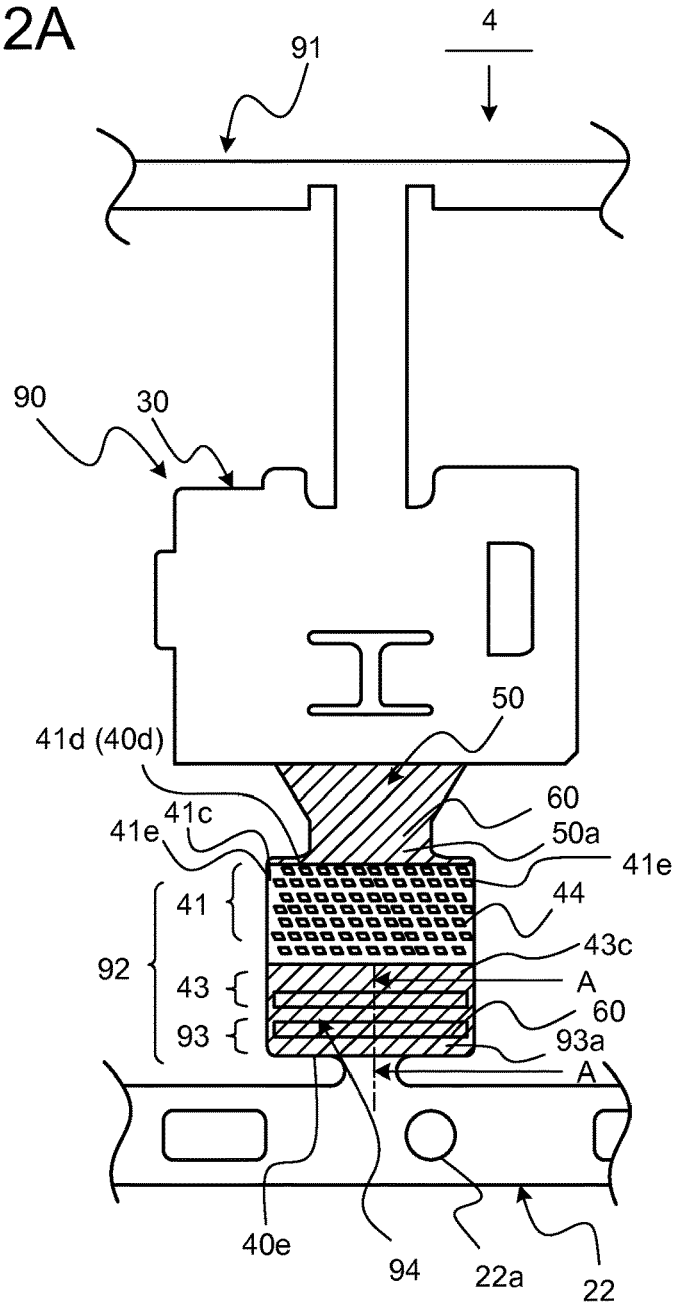
FIG. 12A is a diagram illustrating a punched state of a plate-shaped member to be the material of a terminal metal fitting of an electric wire with terminal metal fitting according to a third modification of the embodiment of the present invention.
Figure 12B:
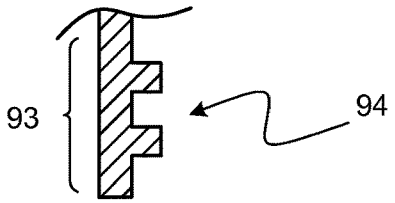
FIG. 12B is an A-A line cross-sectional view of FIG. 12A.

The following describes a third modification of the electric wire with terminal metal fitting 1 according to the embodiment of the present invention using FIGS. 12A and 12B. FIG. 12A is a diagram illustrating a punched state of a plate-shaped member 91 to be the material of a terminal metal fitting 90 of an electric wire with terminal metal fitting 4 according to the third modification of the embodiment of the present invention. FIG. 12B is an A-A line cross-sectional view of FIG. 12A.

The electric wire with terminal metal fitting 4 of this third modification is different from the electric wire with terminal metal fitting 1 of the embodiment in that an uneven surface portion 94 is formed in an insulation-coating press-bonded portion 93 of an electric-wire coupling portion 92 of the terminal metal fitting 90.

Here, the other configurations are similar to those in the embodiment, and like reference numerals designate the configuration portions in common with the embodiment.

The terminal metal fitting 90 includes the uneven surface portion 94 where an inner side surface 93*a* of the insulation-coating press-bonded portion 93 is formed in an irregular shape.

This uneven surface portion 94 is disposed such that protruding portions projecting from the inner side surface 93*a* in rectangular cross sections are arranged. In the case where the insulation-coating press-bonded portion 93 is press-bonded to the insulating coating portion 12, this terminal metal fitting 90 has a function that enhances the close contact strength due to an increase in contacted area between the insulation-coating press-bonded portion 93 and the insulating coating portion 12 by the uneven surface portion 94.

Here, while the exemplified electric wire with terminal metal fitting 4 of this third modification includes the uneven surface portion 94 where the protruding portions projecting from the inner side surface 93*a* in rectangular cross sections are arranged, the configuration is not limited to this. Another shape may be used insofar as the inner side surface 93*a* of the insulation-coating press-bonded portion 93 is formed in an irregular shape.

The electric wire with terminal metal fitting 4 of this third modification allows preventing water invasion into the exposed conductor portion 11 from the outside of the terminal metal fitting 90, similarly to the electric wire with terminal metal fitting 1 of the embodiment. This consequently allows improving the anticorrosive performance. Additionally, the uneven surface portion 94 increases the contacted area between the insulation-coating press-bonded portion 93 and the insulating coating portion 12, so as to enhance the close contact strength between the insulation-coating press-bonded portion 93 and the insulating coating portion 12.

(Fourth Modification)

Figure 13A:
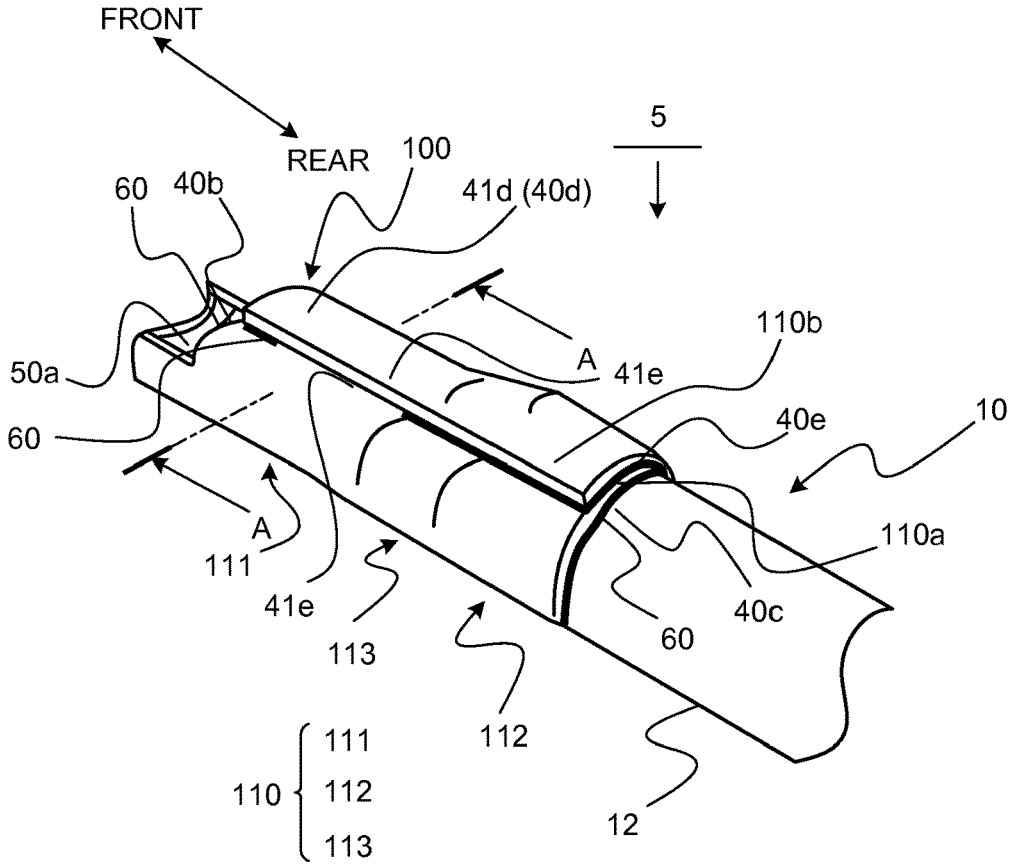
FIG. 13A is an enlarged perspective view of the vicinity of an electric-wire coupling portion of an electric wire with terminal metal fitting according to a fourth modification of the embodiment of the present invention.
Figure 13B:
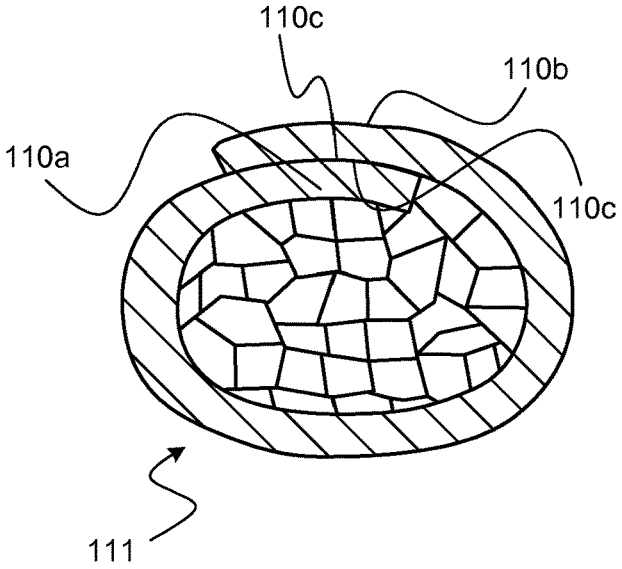
FIG. 13B is an A-A line cross-sectional view of FIG. 13A.

The following describes a fourth modification of the electric wire with terminal metal fitting 1 according to the embodiment of the present invention using FIGS. 13A and 13B. FIG. 13A is an enlarged perspective view of the vicinity of an electric-wire coupling portion 110 of an electric wire with terminal metal fitting 5 according to the fourth modification of the embodiment of the present invention. FIG. 13B is an A-A line cross-sectional view of FIG. 13A.

The electric wire with terminal metal fitting 5 of this fourth modification is different from the electric wire with terminal metal fitting 1 of the embodiment in that the electric-wire coupling portion 110 of a terminal metal fitting 100 is formed in a tube shape where both side end portions 110*a* and 110*b* in the plate-shaped portion are overlap with each other. The electric-wire coupling portion 110 includes an exposed-conductor press-bonded portion 111, an insulation-coating press-bonded portion 112, and an intermediate integrated continuous-contact portion 113.

Here, the other configurations are similar to those in the embodiment, and like reference numerals designate the configuration portions in common with the embodiment.

In the case where the electric-wire coupling portion 110 couples to the electric wire 10, the terminal metal fitting 100 is coupled to the electric wire 10 such that the both side end portions 110*a* and 110*b* in the plate-shaped portion of the electric-wire coupling portion 110 overlap with each other. This ensures the structure that more reliably covers the portion where the both side end portions 110*a* and 110*b* overlap with each other, thus being less likely to cause water invasion from the outside.

The electric wire with terminal metal fitting 5 of this fourth modification allows preventing water invasion into the exposed conductor portion 11 from the outside of the terminal metal fitting 100, similarly to the electric wire with terminal metal fitting 1 of the embodiment. This consequently allows improving the anticorrosive performance.

Additionally, the both side end portions 110*a* and 110*b* of the electric-wire coupling portion 110 overlap with each other. It is less likely to cause water invasion via a mating surface 110*c* of the both side end portions 110*a* and 110*b* from the outside of the terminal metal fitting 100. This allows preventing water invasion into the exposed conductor portion 11 from the outside of the terminal metal fitting 100.

(Fifth Modification)

Figure 14A:
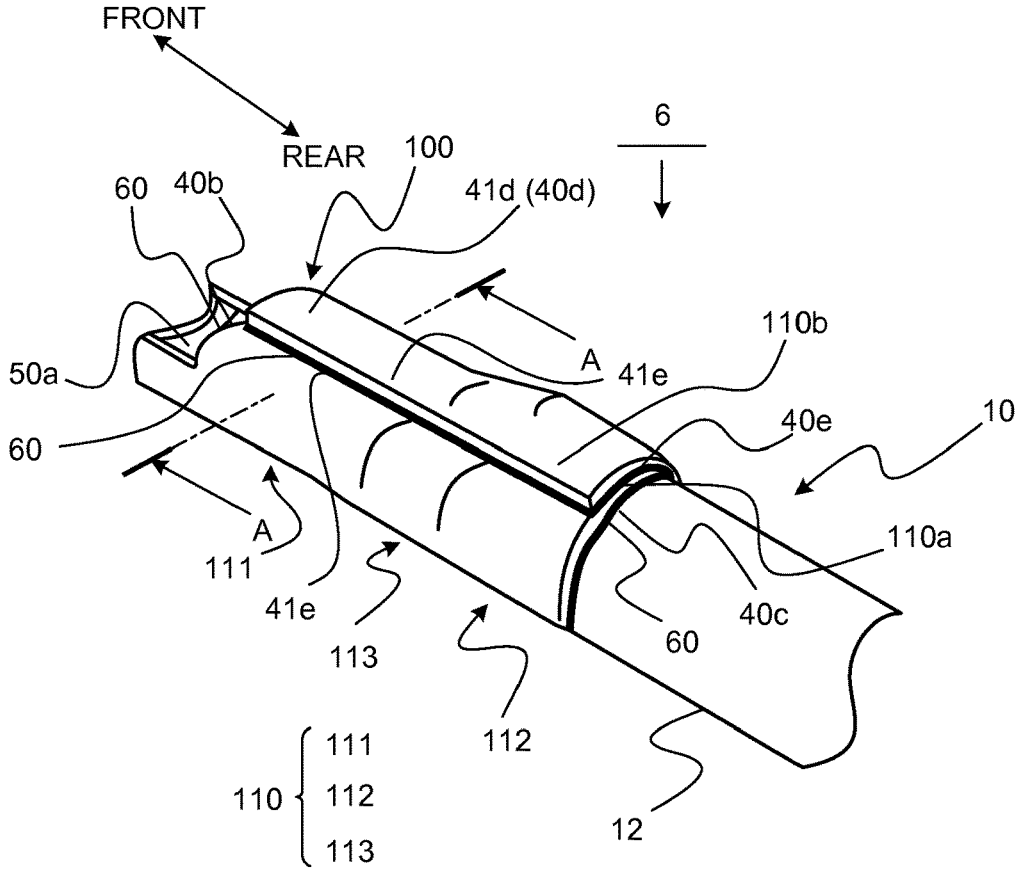
FIG. 14A is an enlarged perspective view of the vicinity of an electric-wire coupling portion of an electric wire with terminal metal fitting according to a fifth modification of the embodiment of the present invention.
Figure 14B:
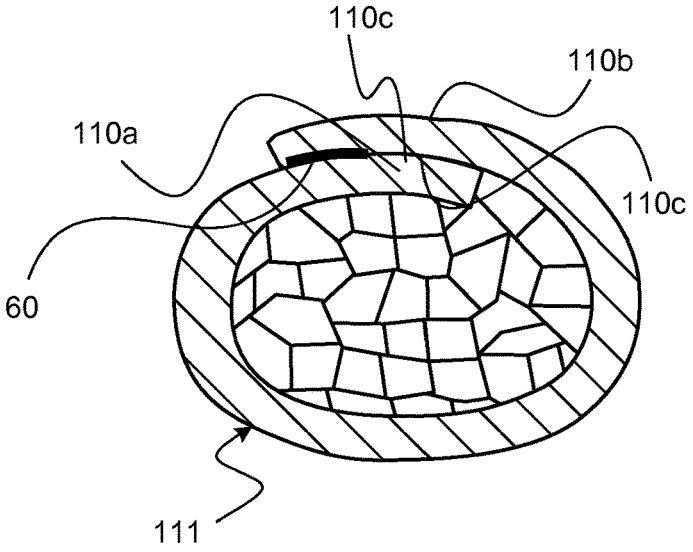
FIG. 14B is an A-A line cross-sectional view of FIG. 14A.

The following describes a fifth modification of the electric wire with terminal metal fitting 1 according to the embodiment of the present invention using FIGS. 14A and 14B. FIG. 14A is an enlarged perspective view of the vicinity of the electric-wire coupling portion 110 of an electric wire with terminal metal fitting 6 according to the fifth modification of the embodiment of the present invention. FIG. 14B is an A-A line cross-sectional view of FIG. 14A.

The electric wire with terminal metal fitting 6 of this fifth modification is different from the electric wire with terminal metal fitting 1 of the embodiment in that: the electric-wire coupling portion 110 of the terminal metal fitting 100 is formed in a tube shape where the both side end portions 110*a* and 110*b* in the plate-shaped portion are overlap with each other; and the insulating resin layer 60 is formed on the inner side surface of the side end portion 110*b* on the outer side in the both side end portions 110*a* and 110*b* overlapping in the exposed-conductor press-bonded portion 111.

Here, the other configurations are similar to those in the embodiment, and like reference numerals designate the configuration portions in common with the embodiment.

The electric wire with terminal metal fitting 6 of this fifth modification is less likely to cause water invasion via the mating surface 110*c* of the both side end portions 110*a* and 110*b* from the outside of the terminal metal fitting 100, similarly to the electric wire with terminal metal fitting 5 of the fourth modification. This allows preventing water invasion into the exposed conductor portion 11 from the outside of the terminal metal fitting 100. Moreover, the thermoplastic insulating resin layer 60 is formed between the both side end portions 110*a* and 110*b* overlapping in the exposed-conductor press-bonded portion 111. This allows more reliably preventing water invasion into the exposed conductor portion 11 from the outside of the terminal metal fitting 100.

Here, while the exemplified electric wire with terminal metal fittings 1, 2, 3, 4, 5, and 6 according to the embodiment of the present invention include: the conductor portions 11 made of aluminum or aluminum alloy; and the terminal metal fittings 20, 70, 80, 90, and 100 made of copper or copper alloy, the configuration is not limited to this. Other metallic materials may be used as the conductor portions 11, and the terminal metal fittings 20, 70, 80, 90, and 100. For example, the conductor portion 11 may employ copper or copper alloy.

While in the exemplified electric wire with terminal metal fittings 1, 2, 3, 4, 5, and 6 according to the embodiment of the present invention the insulating resin layer 60 is formed in: the whole region on the inner side surface 50*a* of the intermediate portion 50; the front end portion 41*d* on the inner side surface 41*c* of the exposed-conductor press-bonded portion 41; the whole region on the inner side surface 43*c* of the intermediate integrated continuous-contact portion 43; and the whole region on the inner side surface 42*c* of the insulation-coating press-bonded portion 42, the configuration is not limited to this. The insulating resin layer 60 only needs to be formed at least in the front end portion and the rear end portion in the extending direction of the electric wire 10 on the inner side surfaces of the electric-wire coupling portions 40, 72, 82, 92, and 110. For example, in the case where the insulating resin layer 60 is formed only in the front end portion and the rear end portion in the extending direction of the electric wire 10, at least both the end openings of the electric-wire coupling portions 40, 72, 82, 92, and 110 are sealed by the insulating resin R.

While in the exemplified electric wire with terminal metal fittings 1, 2, 3, 4, 5, and 6 according to the embodiment of the present invention the distal end portion 11*b* of the exposed conductor portion 11 is housed within the exposed-conductor press-bonded portion, the configuration is not limited to this. The distal end portion 11*b* of the exposed conductor portion 11 may be exposed from the front end openings of the electric-wire coupling portions 40, 72, 82, 92, and 110. Also in this case, the insulating resin R formed in the front end portions of the electric-wire coupling portions 40, 72, 82, 92, and 110 is melted and expands such that the insulating resin R can cover the conductor portion 11 exposed from the front end openings of the electric-wire coupling portions 40, 72, 82, 92, and 110. Additionally, formation of the insulating resin layer 60 in the intermediate portion 50 allows the insulating resin R to more reliably cover the distal end portion 11*b* of the exposed conductor portion 11.

While the invention made by the inventor has been specifically described based on the above-described embodiment of the invention above, the present invention is not limited to the above-described embodiment of the invention. Various changes may be made without departing from the spirit and scope of the present invention.

With the electric wire with terminal metal fitting according to one aspect of the present invention, the intermediate integrated continuous-contact portion ensures integrally continuous contact between the exposed-conductor press-bonded portion and the insulation-coating press-bonded portion along the extending direction of the electric wire such that the exposed conductor portion is not exposed to the outside. Additionally, the insulating resin layer is formed at least in the front end portion and the rear end portion in the extending direction of the electric wire on the inner side surface of the electric-wire coupling portion. Accordingly, in the case where the insulating resin is heated at the melting temperature, the gap between the terminal metal fitting and the electric wire can be reliably sealed by the insulating resin in the front end portion and the rear end portion of the electric-wire coupling portion. This allows reliably preventing water invasion into the exposed conductor portion from the outside of the terminal metal fitting, thus consequently improving the anticorrosive performance.

With the electric wire with terminal metal fitting according to another aspect of the present invention allows reliably covering the distal end of the conductor portion exposed by melting the insulating resin layer formed in the front end portion in the extending direction of the electric wire on the inner side surface of the electric-wire coupling portion.

With the electric wire with terminal metal fitting according to still another aspect of the present invention, the pair of press-bonded piece portions, which is formed in the insulation-coating press-bonded portion, is likely to be bent and deformed. This facilitates press-bonding the insulation-coating press-bonded portion to the insulating coating portion. Moreover, the insulating coating portion digs into the slit-shaped notch. This allows enhancing the close contact strength between the insulation-coating press-bonded portion and the insulating coating portion.

With the electric wire with terminal metal fitting according to still another aspect of the present invention, in the case where the insulation-coating press-bonded portion is press-bonded to the insulating coating portion, the insulating coating portion digs into the through-hole. This allows enhancing the close contact strength between the insulation-coating press-bonded portion and the insulating coating portion.

With the electric wire with terminal metal fitting according to still another aspect of the present invention, the uneven surface portions increase: the contacted area between the exposed-conductor press-bonded portion and the conductor portion; and the contacted area between the insulation-coating press-bonded portion and the insulating coating portion. This allows enhancing: the close contact strength between the exposed-conductor press-bonded portion and the conductor portion; and the close contact strength between the insulation-coating press-bonded portion and the insulating coating portion.

With the electric wire with terminal metal fitting according to still another aspect of the present invention, the both side end portions of the electric-wire coupling portion overlap with each other. It is less likely to cause water invasion via the mating surface of the both side end portions from the outside of the terminal metal fitting. This allows preventing water invasion into the exposed conductor portion from the outside of the terminal metal fitting.

With the electric wire with terminal metal fitting according to still another aspect of the present invention, the thermoplastic insulating resin layer is formed between the both side end portions overlapping in the exposed-conductor press-bonded portion. This allows more reliably preventing water invasion into the exposed conductor portion from the outside of the terminal metal fitting.

The electric wire with terminal metal fitting according to still another aspect of the present invention allows reliably preventing water invasion into the exposed conductor portion from the outside of the terminal metal fitting, even when the combination of the material of the conductor portion and the material of the terminal metal fitting is the combination of the materials that is likely to be eroded. This allows improving the anticorrosive performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire and a terminal metal fitting, comprising:

the electric wire including a conductor portion, and an insulating coating portion surrounding an outer periphery of the conductor portion; and the terminal metal fitting including an electric-wire coupling portion coupled to a terminal portion of the electric wire and a partner-terminal coupling portion connected to the electric-wire coupling portion, wherein the electric-wire coupling portion includes:

an exposed-conductor press-bonded portion disposed on a front end side of the electric-wire coupling portion in an extending direction of the electric wire and press-bonded to the conductor portion of the electric wire exposed by removing a portion of the insulating coating portion of the electric wire from a distal end of the terminal portion of the electric wire;

an insulation-coating press-bonded portion disposed on a rear end side of the electric-wire coupling portion in the extending direction of the electric wire and press-bonded to the insulating coating portion of the electric wire; and a tapered intermediate integrated continuous-contact portion integrally and continuously connecting between the exposed-conductor press-bonded portion and the insulation-coating press-bonded portion along the extending direction of the electric wire such that the conductor portion of the electric wire is not exposed to an outside, wherein the electric-wire coupling portion of the terminal metal fitting has an inner side surface where an insulating resin layer is formed at least on a front end portion and a rear end portion thereof in the extending direction of the electric wire, and, on the inner side surface of the electric-wire coupling portion, the insulating resin layer is not formed on at least a part of a portion of the exposed-conductor press-bonded portion, wherein the insulating resin layer includes a thermoplastic resin, and insulating resin of the insulating resin layer is heated at a temperature where the insulating resin is melted such that a gap between the terminal metal fitting and the electric wire is sealed by the insulating resin at a front end portion and a rear end portion of the electric-wire coupling portion, wherein the exposed-conductor press-bonded portion and the intermediate integrated continuous-contact portion completely encircle the electric wire in a circumferential direction of the electric wire continuously throughout an extension of the exposed-conductor press-bonded portion and the intermediate integrated continuous-contact portion in the extending direction of the electric wire, and wherein the electric-wire coupling portion includes a front end opening on a front end side thereof in a direction extending toward the partner-terminal coupling portion, and the insulating resin is melted to cover a distal end portion of the conductor portion of the electric wire, including a distal front longitudinal face of the conductor portion.

2. The electric wire and the terminal metal fitting according to claim 1, wherein the distal end portion of the conductor portion of the electric wire is housed within the exposed-conductor press-bonded portion.

3. The electric wire and the terminal metal fitting according to claim 2, wherein the conductor portion of the electric wire is made of aluminum or aluminum alloy, and the terminal metal fitting is made of copper or copper alloy.

4. The electric wire and the terminal metal fitting according to claim 1, wherein the conductor portion of the electric wire is made of aluminum or aluminum alloy, and the terminal metal fitting is made of copper or copper alloy.

* * * * *